US006010086A

United States Patent [19]

Earle, III et al.

[11] Patent Number: 6,010,086

[45] Date of Patent: Jan. 4, 2000

[54] GRINDER PUMP

[75] Inventors: George A. Earle, III, Clifton Park; Clark A. Henry, Scotia; Mark E. Alexander, Clifton Park, all of N.Y.

[73] Assignee: Enviroment One Corporation, Niskayuna, N.Y.

[21] Appl. No.: 09/109,540

[22] Filed: Jul. 2, 1998

[51] Int. Cl.[7] ..... B02C 23/36

[52] U.S. Cl. ..... 241/46.11; 241/185.6

[58] Field of Search ..... 210/173, 174; 415/121.1; 418/48, 182; 241/101.2, 46.017, 46.11, 185.6

[56] References Cited

U.S. PATENT DOCUMENTS

| | | | |
|---|---|---|---|
| 3,667,692 | 6/1972 | Grace . | |
| 3,938,744 | 2/1976 | Allen . | |
| 4,000,858 | 1/1977 | Rudzinski . | |
| 4,014,475 | 3/1977 | Grace et al. . | |
| 4,378,093 | 3/1983 | Keener . | |
| 4,637,785 | 1/1987 | Backstrom | 241/185.6 |
| 4,911,368 | 3/1990 | Nishimori . | |
| 5,044,566 | 9/1991 | Mitsch . | |
| 5,553,794 | 9/1996 | Oliver et al. . | |
| 5,562,254 | 10/1996 | Sleasman et al. . | |

*Primary Examiner*—Mark Rosenbaum
*Attorney, Agent, or Firm*—Healin & Rothberg, P.C.

[57] ABSTRACT

A grinder pump includes a pump assembly, a grinder mechanism, and a motor disposed between the grinder mechanism and the pump assembly. A shaft of the motor is operably attached at one end thereof to the grinder mechanism and at the other end thereof to the pump assembly. This arrangement enables providing smaller radial clearances between the cutting portions of the grinder mechanism. Vortex-type impeller vanes can be associated with a grinding head of the grinder mechanism to assist flow of effluent from the grinder mechanism to the pump assembly via a passageway extending about, and/or in parallel with, a motor mounting unit.

29 Claims, 3 Drawing Sheets

GRINDER PUMP

BACKGROUND OF THE INVENTION

1. Field of the Invention

The present invention relates generally to grinder pumps. More particularly, the present invention relates to a novel arrangement of components of grinder pumps including a motor, a grinder mechanism, and a pump assembly.

2. Background Information

Grinder pumps are often used in sewage systems for pumping sewage and include a grinder mechanism for cutting or grinding solids or semisolid matter in the material being pumped. Desirably, grinding solids and/or semisolid matter in the sewage allows the resulting particulate effluent to be transferred through smaller diameter pipes without clogging.

FIG. 1 illustrates a prior art grinder pump 10 which comprises a housing 12 having a motor 20 disposed therein. Motor 20 is connected to a progressing cavity pump 30 which, in turn, is attached to a grinder mechanism 40.

Specifically, motor 20 comprises a shaft 22 which extends from the lower portion of motor 20. Shaft 22 extends through a pump rotor 32 of progressing cavity pump 30 and the lower end of shaft 22 attaches to a grinding head 42 of grinder mechanism 40. Grinding head 42, is essentially supported at position A by being cantilevered from a bearing 24 at position B.

A drawback with the prior art grinder pump illustrated in FIG. 1 is the limited ability to provide and maintain close radial clearance between the cutting portions 44 of grinding head 42 and a stationary grinding ring 46 for efficiently and finely grinding wastes. In particular, the eccentric orbiting of pump rotor 32 within a pump stator 34 of progressing cavity pump 30 induces side loads which limit the ability to safely maintain close cutting tolerances between the cutting portions of the grinding head and grinding ring.

In large progressing cavity pumps, it is often advantageous to allow angular and/or radial compliance or displacement of the rotor shaft to reduce the rate of wear of the pump rotor and/or pump stator. This can be provided through the use of one universal joint for angular displacement of the shaft or two universal joints for angular and radial displacement of the shaft. However, incorporation of a rotor shaft having one or more universal joints in the prior art grinder pump illustrated in FIG. 1 renders properly supporting the grinding head impractical if not impossible.

Examples of prior art grinder pumps having a motor attached to a pump, which, in turn, is attached to a grinder mechanism, are disclosed in U.S. Pat. Nos. 3,667,692 to Grace; 3,938,744 to Allen; 4,000,858 to Rudzinski; 4,014,475 to Grace et al.; 4,378,093 to Keener; 4,911,368 to Nishimori; 5,044,566 to Mitsch; 5,553,794 to Oliver et al.; and 5,562,254 to Sleasman et al.

Therefore, there is a need for novel grinder pumps having a stable, rotating assembly, which enable tighter or smaller radial clearances between the cutting portions of the grinder mechanism to improve cutting efficiency, and/or which enable angular and/or radial displacement of the processing cavity pump without sacrificing cutting efficiency.

SUMMARY OF THE INVENTION

Pursuant to the present invention, the shortcomings of the prior art are overcome and additional advantages provided through the provision of a grinder pump comprising a housing, a grinder mechanism, a pump assembly, and a motor disposed in the housing and operably attached to the grinder mechanism and to the pump assembly so that the motor is disposed between the grinder mechanism and the pump assembly. Preferably, the motor includes a shaft having an upper end portion operably attached to the pump assembly, and an opposite lower end portion operably attached to the grinder mechanism.

Desirably, the grinder mechanism comprises a rotating grinding head and a stationary grinding ring, and the pump assembly comprises a progressing cavity pump having a pump rotor and a pump stator.

Advantageously, the motor is an electric motor rated at about 1 horsepower to about 7.5 horsepower, and the grinder pump assembly has a flow rate of about 10 gallons per minute to about 75 gallons per minute.

In a preferred embodiment of the present invention, the grinder pump includes a flexible coupling, e.g, a universal joint, for operably attaching the motor to the pump assembly, and the grinding head includes a plurality of vortex-type impeller vanes.

Desirably, the housing comprises an outer shell and a motor mounting unit which define therebetween an annular passageway for fluid communication between the grinder mechanism and the pump assembly. Advantageously, the motor mounting unit comprises cast iron and is structured so that the motor mounting unit is substantially explosion proof.

In another embodiment of the present invention a grinder pump includes a tube for fluid communication between the grinder mechanism and the pump assembly.

BRIEF DESCRIPTION OF THE DRAWINGS

These and other objects, advantages and features of the present invention will be more readily understood from the following detailed description of certain preferred embodiments of the present invention, when considered in conjunction with the accompanying drawings in which.

DETAILED DESCRIPTION OF THE PREFERRED EMBODIMENTS

Figure 2:
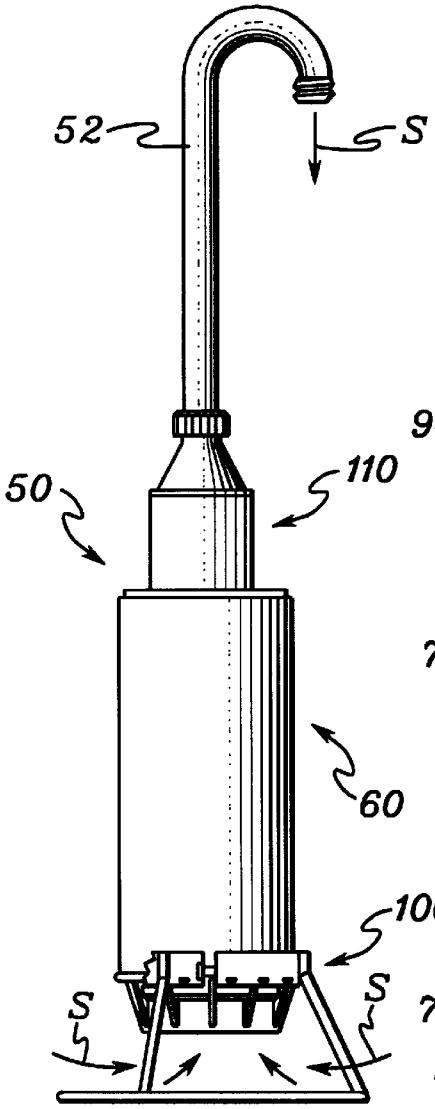
FIG. 2 is a side elevational view of one embodiment of a grinder pump according to the present invention.
Figure 3:
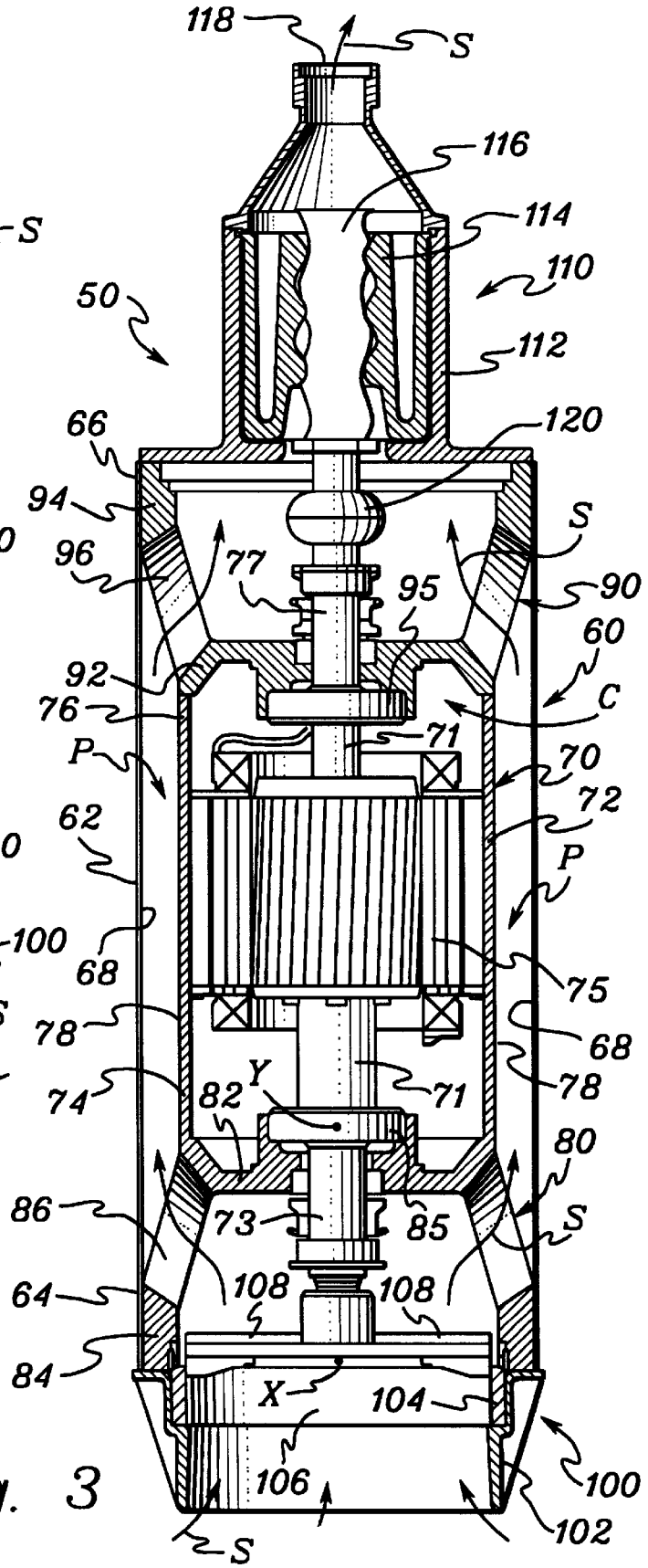
FIG. 3 is an enlarged cross-sectional view of the grinder pump shown in FIG. 2.

With reference to FIGS. 2 and 3, therein illustrated is one embodiment of a grinder pump 50 constructed in accordance with the principles of the present invention. Illustrated grinder pump 50 optimizes the performance of a grinder mechanism 100 and/or a pump assembly 110 by configuring grinder pump 50 so that a motor 75 (FIG. 3) is operably disposed between grinder mechanism 100 and pump assembly 110. Desirably, positioning motor 75 between grinder mechanism 100 and pump assembly 110 provides a stable, rotating assembly, whereby radial clearances in grinder mechanism 100 can be reduced to improve cutting efficiency.

As shown in FIG. 2, grinder pump 50 includes a cylindrically-shaped housing 60 having a lower portion which attaches to grinder mechanism 100 and an upper portion which attaches to pump assembly 110. In operation, sewage containing solids and semisolid matter is drawn into grinder mechanism 100, as illustrated by the curved arrows S in FIG. 2, for cutting or grinding of the solids or semisolid matter in the sewage being pumped. The resulting particulate effluent is passed through housing 60, pump assembly 110 and is discharged from a tube 52.

As best shown in FIG. 3, housing 60 preferably comprises a hollow, cylindrically-shaped outer shell 62 and a motor mounting unit 70 disposed therein for containing and supporting motor 75. Outer shell 62 has a lower open end 64 and an upper open end 66.

Motor mounting unit 70 comprises a hollow, cylindrically-shaped central member 72, a lower end support 80, and an upper end support 90. Central member 72 has a lower open end 74 and an upper open end 76.

Lower end support 80 comprises an end cap 82 and a spaced-apart support ring 84. Lower end cap 82 is sized and configured to threadably and sealably engage lower open end 74 of central member 72. Support ring 84 is sized and configured to fit within lower open end 64 of shell 62. A plurality of struts 86 (two of which are shown in FIG. 3) connect end cap 82 to support ring 84.

Upper end support 90 comprises an end cap 92 and a spaced-apart support ring 94. Upper end cap 92 is sized and configured to threadably and sealably engage upper open end 76 of central member 72. Support ring 94 is sized and configured to fit within upper open end 66 of shell 62. A plurality of struts 96 (two of which are shown in FIG. 3) connect cap 92 to support ring 94.

Central member 72 of motor mounting unit 70 is supported by upper and lower end supports 80 and 90 so that central member 72 is disposed desirably concentrically in outer shell 62 to define an annular passageway P between an inner surface 68 of shell 62 and an outer surface 78 of central member 72.

Motor 75 includes a shaft 71 having a lower end portion 73 rotatably supported by a bearing 85 mounted in end cap 82, and an upper end portion 77 rotatably supported by a bearing 95 mounted in end cap 92. Suitable mechanical seals define a fluid tight chamber C defined by the interior of central member 72 and end caps 82 and 92. Preferably, motor 75 is an electrical motor rated at about 1 horsepower to about 7.5 horsepower.

Desirably, central member 72 and end caps 82 and 92 are fabricated from cast iron and outer shell 62 is fabricated from stainless steel, although other suitable materials may also be employed. In addition, central member 72 and end caps 82 and 92 can be configured and suitably attached to each other so that chamber C is generally explosion proof.

Figure 1:
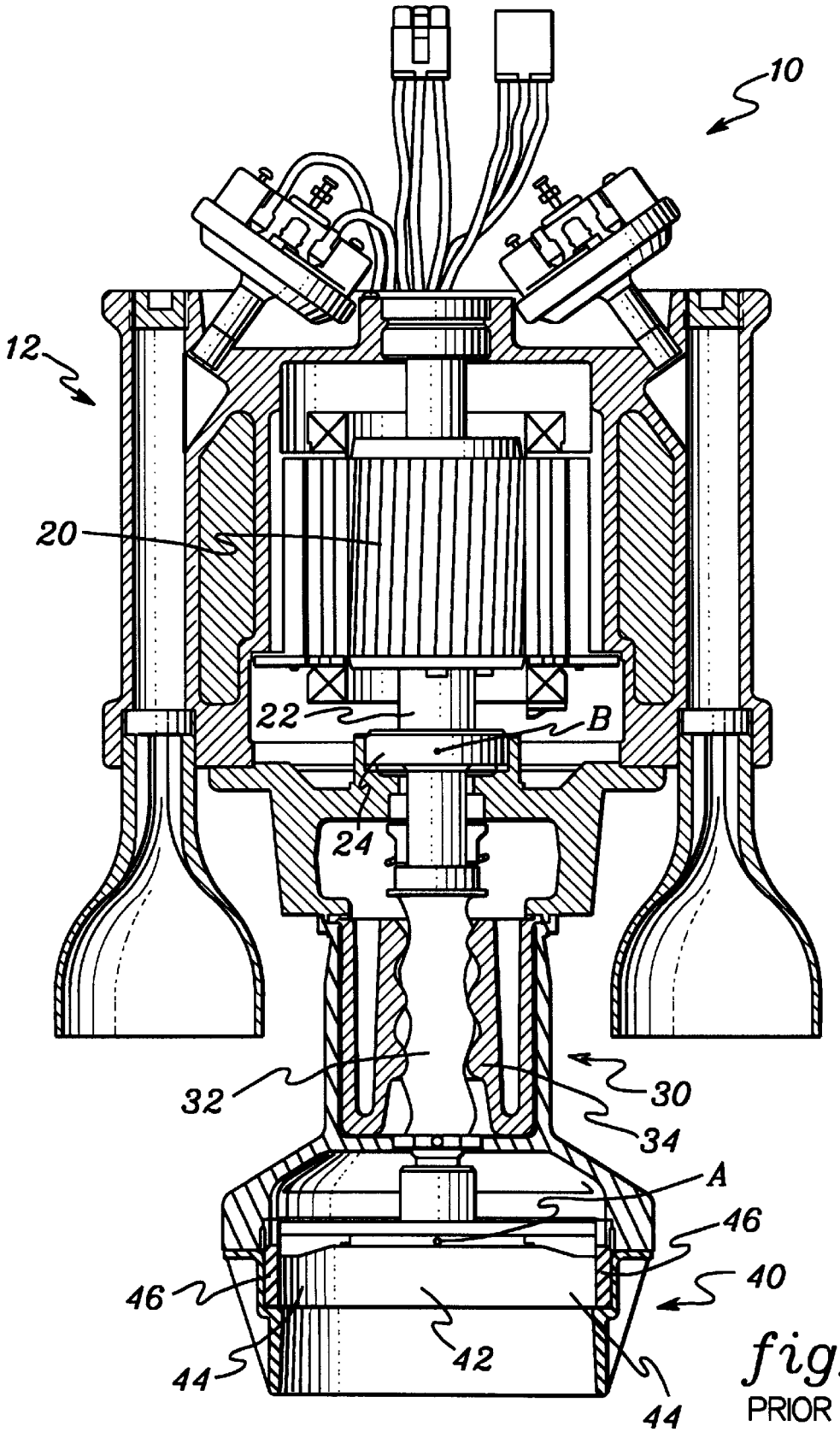
fig. 1 PRIOR ART
FIG. 1 is a cross-sectional view of a prior art grinder pump.

Grinder mechanism 100 comprises an outer shroud 102 having a stationary grinding ring 104. Shroud 102 is attached at its upper end to the lower end of housing 60. A rotating grinding head 106 is connected to motor shaft 73. Desirably, impeller or angled vanes 108 operably extend from the upper end portions of grinding head 106 to enhance the upward flow of fluid through grinder pump 50 and to reduce the suction head leading into pump assembly 110. As shown in FIG. 3, grinding head 106 is essentially supported at position X by being cantilevered from bearing 85 at position Y. Since the pump assembly is not disposed between the motor and the grinding head in the present invention, the distance between positions X and Y is desirably less than that required if the pump assembly was disposed between the motor and the grinding head, e.g., the distance between positions A and B of the prior art grinder pump shown in FIG. 1. Accordingly, the cutting portions of the grinding head and the grinding ring of the present invention can be fabricated with closer or tighter tolerances compared to the prior art grinder pumps. Desirably, the grinder mechanism has a clearance of about 0.010 inch to about 0.050 inch, and preferably 0.030 inch, between the cutting portions of the grinding head and the grinding ring.

Preferably, pump assembly 110 is a progressing cavity pump comprising a pump housing 112, a pump stator 114, and a pump rotor 116. Pump housing 112 is attached at its lower end to the upper end of housing 60 and stator 114 is fixedly mounted in pump housing 112. Desirably, pump rotor 116 is connected at its lower end to upper end portion 77 of shaft 71 via a flexible coupling 120, e.g., a universal joint. In this configuration, pump rotor 116 has ample compliance and is able to ride freely in the bore of pump stator 114 to reduce wear. Also, cyclic distortion and displacement of the pump stator is reduced thereby reducing fatigue in the pump stator. Alternatively, shaft 71 may comprise a flexible shaft extension which attaches to the pump rotor. In contrast to conventional grinder pumps which use a pump stator configuration in which the pump stator must provide all the compliance, this embodiment of the present invention allows the pump rotor and pump stator to each contribute to the required compliance. Preferably, pump assembly 110 has a flow rate of about 10 gallons per minute to about 75 gallons per minute.

In operation, sewage is processed and pumped through grinder pump 50 as shown by arrows S in FIG. 3. In particular, sewage is initially drawn into grinder mechanism 100. The sewage then travels upwardly between struts 86 in lower end support 80 and upwardly about central member 72 through annular passageway P. The sewage then travels upwardly between struts 96 of upper support 90 and into and out of pump assembly 110 where it is then discharged through discharge outlet 118. Advantageously, the sewage passing through annular passageway P thermally cools central member 72, and thus, thermally cools motor 75.

From the present description, it will be appreciated by those skilled in the art that motor 75 is sealed within chamber C so that the entire assembly can be submerged in the fluid being pumped. With this design, housing 60 need not be watertight.

While progressing cavity pumps typically require periodic pump stator replacement due to wear, with the pump stator located on the top of the housing and readily accessible, the pump stator and/or entire pump assembly can be easily repaired or replaced with minimal downtime and/or disassembly.

From the present description, it will also be appreciated by those skilled in the art that while the present invention has been described and illustrated as a progressing cavity grinder pump, the present invention is also applicable, with appropriate modifications, to centrifugal-type grinder pumps.

Figure 4:
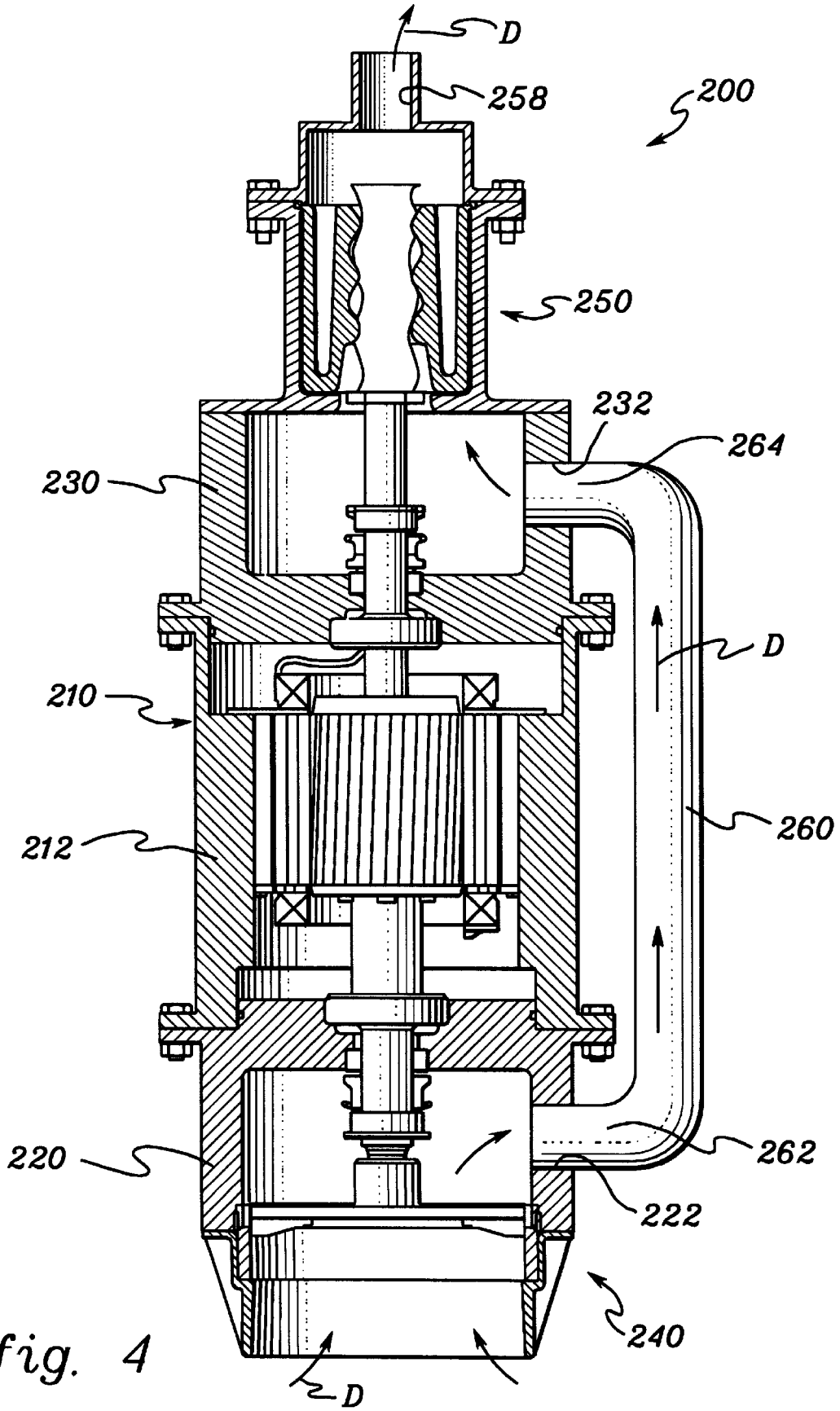
FIG. 4 is a cross-sectional view of an alternative embodiment of a grinder pump according to the present invention.

As shown in FIG. 4, an alternative embodiment of a grinder pump 200 according to the present invention comprises a housing 210 having a central cylindrical portion 212, a lower cup-shaped end cap 220 which attaches to a grinder mechanism 240, and an upper cup-shaped end cap 230 which attaches to a pump assembly 250.

Lower cup-shaped end cap 220 is provided with a discharge outlet 222, and upper cup-shaped end cap 230 is provided with inlet 232. A tube 260 having a first end 262 which attaches to discharge outlet 222 and an opposite second end 264 which attaches to inlet 232 transfers fluid from grinder mechanism 240 to pump assembly 250.

In operation, sewage is pumped through grinder pump 200 as shown by arrows D in FIG. 4. In particular, sewage is initially drawn into grinder mechanism 240. The sewage then travels upwardly through discharge outlet 222 and upwardly through tube 260 into inlet 232 where it is then pumped through pump assembly 250 and out discharge outlet 258.

While the present invention has been described for use in pumping sewage, it will be appreciated by those skilled in the art that the present invention is also suitable for processing other types of fluids having solids and/or semisolid matter, e.g., use in commercial manufacturing processes or commercial waste streams. In addition, it is possible to attach a pipe for providing a supply of fluid to be processed directly to the inlet/grinder mechanism, e.g., to provide an inline grinder pump.

Thus, while two embodiments of the present invention have been illustrated and described, it will be appreciated to those skilled in the art that many changes and modifications may be made thereunto without departing from the spirit and scope of the invention.

What is claimed is:

1. A grinder pump comprising:

a housing;

a grinder mechanism;

a pump assembly; and a motor disposed in said housing and comprising a shaft having a first end portion operably attached to said grinder mechanism, and an opposite end portion operably attached to said pump assembly.

2. The grinder pump according to claim 1, wherein said motor comprises a shaft having a lower end portion operably attached to said grinder mechanism, and an opposite upper end portion operably attached to said pump assembly.

3. The grinder pump according to claim 1, wherein said pump assembly comprises a progressing cavity pump.

4. The grinder pump according to claim 3, wherein said progressing cavity pump comprises a pump rotor and a pump stator.

5. The grinder pump according to claim 4, wherein said motor comprises a shaft having an upper end portion and a lower end portion, said pump rotor being attached to said upper end portion of said shaft, and said pump stator being attached to said housing.

6. The grinder pump according to claim 1, wherein said grinder mechanism comprises a rotating grinding head and a stationary grinding ring.

7. The grinder pump according to claim 6, wherein said grinding head comprises a plurality of vortex-type impeller vanes.

8. The grinder pump according to claim 6, wherein said motor comprises a shaft having an upper end portion and a lower end portion, said grinding head being attached to said lower end portion of said shaft, and said grinding ring being attached to said housing.

9. The grinder pump according to claim 8, wherein said grinder mechanism comprises a clearance of about 0.010 inch to about 0.050 inch between at least one cutting portion of said grinding head and said grinding ring.

10. The grinder pump according to claim 9, wherein said grinder mechanism comprises a clearance of about 0.030 inch between at least one cutting portion of said grinding head and said grinding ring.

11. The grinder pump according to claim 1, wherein said motor is an electric motor.

12. The grinder pump according to claim 11, wherein said electric motor is rated at about 1 horsepower to about 7.5 horsepower.

13. The grinder pump according to claim 12, wherein said grinder pump has a flow rate of about 10 gallons per minute to about 75 gallons per minute.

14. The grinder pump according to claim 1, further comprising a flexible coupling for operably attaching said motor to said pump assembly.

15. The grinder pump according to claim 14, wherein said flexible coupling comprises a universal joint.

16. The grinder pump according to claim 1, wherein said motor comprises a shaft having a flexible shaft extension for operably attaching said motor to said pump assembly.

17. The grinder pump according to claim 1, wherein said housing comprises an outer shell and a motor mounting unit which define therebetween an annular passageway for fluid communication between said grinder mechanism and said pump assembly.

18. The grinder pump according to claim 17, wherein said motor mounting unit comprises cast iron.

19. The grinder pump according to claim 18, wherein said motor mounting unit is substantially explosion proof.

20. The grinder pump according to claim 1, further comprising a tube for fluid communication between said grinder mechanism and said pump assembly.

21. A grinder pump comprising:

a housing;

a grinder mechanism comprising a grinding head and a grinding ring;

a progressing cavity pump comprising a pump rotor and a pump stator; and a motor disposed in said housing and comprising a shaft having an upper end portion operably attached to said pump rotor of said progressing cavity pump, and an opposite lower end portion operably attached to said grinding head of said grinder mechanism.

22. The grinder pump according to claim 21, wherein said grinder mechanism comprises a clearance of about 0.010 inch to about 0.050 inch between at least one cutting portion of said grinding head and said grinding ring.

23. The grinder pump according to claim 22, wherein said grinder mechanism comprises a clearance of about 0.030 inch between at least one cutting portion of said grinding head and said grinding ring.

24. The grinder pump according to claim 22, wherein said motor is an electric motor.

25. The grinder pump according to claim 24, wherein said electric motor is rated at about 1 horsepower to about 7.5 horsepower, and wherein said grinder pump has a flow rate of about 10 gallons per minute to about 75 gallons per minute.

26. The grinder pump according to claim 25, further comprising a flexible coupling for operably attaching said motor to said progressing cavity pump.

27. The grinder pump according to claim 26, wherein said grinding head comprises a plurality of vortex-type impeller vanes.

28. The grinder pump according to claim 27, wherein said housing comprises an outer shell and a motor mounting unit which define therebetween an annular passageway for fluid communication between said grinder mechanism and said progressing cavity pump.

29. The grinder pump according to claim 27, further comprising a tube for fluid communication between said grinder mechanism and said progressing cavity pump.

* * * * *